US007984903B2

(12) United States Patent
Coret et al.

(10) Patent No.: US 7,984,903 B2
(45) Date of Patent: Jul. 26, 2011

(54) DEVICE FOR AUTOMATICALLY JOGGING MAILPIECES

(75) Inventors: Francis Coret, Gournay sur Marne (FR); Yannick Claris, Fontenay Aux Roses (FR)

(73) Assignee: Neopost Technologies, Bagneux (FR)

( * ) Notice: Subject to any disclaimer, the term of this patent is extended or adjusted under 35 U.S.C. 154(b) by 136 days.

(21) Appl. No.: 12/348,614

(22) Filed: Jan. 5, 2009

(65) Prior Publication Data

US 2009/0184460 A1 Jul. 23, 2009

(30) Foreign Application Priority Data

Jan. 17, 2008 (FR) ..... 08 50287

(51) Int. Cl.
*B65H 1/00* (2006.01)
*B65H 9/04* (2006.01)

(52) U.S. Cl. ..... 271/171; 271/253

(58) Field of Classification Search ..... 271/248, 271/250, 171, 220, 221, 223, 224, 253; 414/788.9, 414/789.1

See application file for complete search history.

(56) References Cited

U.S. PATENT DOCUMENTS

| | | | | |
|---|---|---|---|---|
| 4,874,160 | A * | 10/1989 | Yamamoto | 271/227 |
| 4,908,673 | A * | 3/1990 | Muramatsu | 399/402 |
| 5,292,223 | A * | 3/1994 | Meschi | 414/788 |
| 6,231,039 | B1 * | 5/2001 | Chung | 270/58.01 |
| 6,523,822 | B1 * | 2/2003 | Galtier et al. | 271/171 |
| 7,635,123 | B2 * | 12/2009 | Watanabe et al. | 271/9.09 |
| 2006/0255531 | A1 * | 11/2006 | Azzopardi et al. | 271/171 |
| 2007/0057429 | A1 * | 3/2007 | Watanabe et al. | 271/9.01 |

FOREIGN PATENT DOCUMENTS

| | | |
|---|---|---|
| EP | 1 088 600 A1 | 4/2001 |
| FR | 2 859 195 A1 | 3/2005 |

* cited by examiner

*Primary Examiner* — Kaitlin S Joerger
*Assistant Examiner* — Patrick Cicchino
(74) *Attorney, Agent, or Firm* — Sughrue Mion, PLLC

(57) ABSTRACT

A jogging device for a feeder of a mail handling machine, which jogging device comprises a side jogging abutment mounted to move, under the action of a drive motor, along a guide rail that is disposed perpendicularly to a referencing wall, said side jogging abutment being provided with at least: a first sensor that is fastened to its base and that, when unmasked, causes said side jogging abutment to move towards said referencing wall, and, when masked, causes this movement to stop; and a second sensor that is fastened to the top of said side jogging abutment and that, when masked, causes said side jogging abutment to move away from said referencing wall, and, when unmasked, causes this movement to stop.

9 Claims, 3 Drawing Sheets

DEVICE FOR AUTOMATICALLY JOGGING MAILPIECES

TECHNICAL FIELD

The present invention relates exclusively to the field of mail handling, and it relates more particularly to document feeders.

PRIOR ART

Feed modules or "feeders" of mail handling machines are well known. In addition to having rollers that are designed to select and take documents, and that are disposed downstream from a platform for receiving mailpieces, every such feeder has a positioning system on said platform for the purpose of positioning said mailpieces appropriately with a view to them being engaged by the rollers for selecting and taking documents. Such positioning often takes place via the side of the mailpiece, as shown in Patent Document FR 2 859 195 filed in the name of the Applicant, and that discloses a mail handling assembly whose feeder has a side jogging device for pressing the mailpieces against a referencing wall. That side jogging device is mounted to slide in a transverse groove, perpendicularly to the direction of advance of the mailpieces and to the referencing wall for referencing the mailpieces. Thus, the operator must always position the mailpieces against said referencing wall, i.e. must push the jogging device against the mailpieces in order to hold them. Unfortunately, the operator cannot be constantly available at the feeder, ready to perform this operation. As a result, the mailpieces are mostly engaged askew, giving rise jams and to skewed franking that causes the mailpiece to be rejected by the postal sorting systems designed to receive them.

OBJECT AND DEFINITION OF THE INVENTION

An object of the present invention is thus to propose a jogging device for a document feeder of a mail-handling machine that makes it possible for both small-format and large-format mailpieces to be jogged in satisfactory manner, without requiring the constant presence of an operator at the machine. Another object of the invention is to perform this positioning rapidly without significantly increasing feeder size relative to current feeder size.

These objects are achieved by a jogging device for a feeder of a mail handling machine, which jogging device comprises a side jogging abutment mounted to move, under the action of a drive motor, along a guide rail that is disposed perpendicularly to a referencing wall, wherein said side jogging abutment is provided with at least: a first sensor that is fastened to its base and that, when unmasked, causes said side jogging abutment to move towards said referencing wall, and, when masked, causes this movement to stop; and a second sensor that is fastened to the top of said side jogging abutment and that, when masked, causes said side jogging abutment to move away from said referencing wall, and, when unmasked, causes this movement to stop.

Thus, providing the mailpieces are previously sorted in decreasing order of format size, with the largest-format mailpieces being placed at the bottom, jogging of an entire stack can be performed automatically without the presence of an operator. The operator then merely needs to put the first mailpieces of the next stack onto the jogging abutment in order to launch the handling automatically, without the continued presence of the operator then being necessary.

In a particular embodiment, said side jogging abutment is further provided with a pressure sensor disposed on its inside edge and designed to cause said side jogging abutment to move to an additional extent as a function of the pressure exerted by said inside edge on said mailpieces.

In a particular embodiment, said platform is further provided with an envelope presence sensor disposed in the vicinity of said referencing wall and passing through said platform, in order to detect the presence of at least one mailpiece on said platform.

Preferably, said side jogging abutment is mounted at an end of a bar that forms the head end of the bar, and the other end of the bar, i.e. its end forming its foot, receives a T-shaped carriage that is mounted to slide in two slide channels that are respectively [-shaped and ]-shaped, that face each other, and that, together, form said guide rail.

Advantageously, said carriage, which is mounted to move between two end-of-stroke abutments, is secured to a belt moving between two pulleys, one of which is mounted to rotate freely on a pin secured to the structure of the mailpiece-receiving module, and the other of which is driven by said drive motor.

Preferably, said first end-of-stroke abutment is disposed in a manner such that said side jogging abutment is positioned a little way inside the minimum allowable format, and said second end-of-stroke abutment is disposed in a manner such that said side jogging abutment is positioned a little way outside the maximum allowable format.

In a particular embodiment, the jogging device may also be provided with a position sensor for defining a reference zero position for said drive motor, a stationary portion of which sensor is fastened to said guide rail and a moving portion of which sensor is secured to said carriage. Said reference zero position corresponds to said side jogging abutment being in a position in which it is aligned on the outside edge of said platform.

The present invention also provides a feeder for a mail-handling machine, which feeder includes such a jogging device.

BRIEF DESCRIPTION OF THE DRAWINGS

Other characteristics and advantages of the present invention appear more clearly from the following description given by way of indication and with reference to the accompanying drawings, in which.

DETAILED DESCRIPTION

Figure 1:
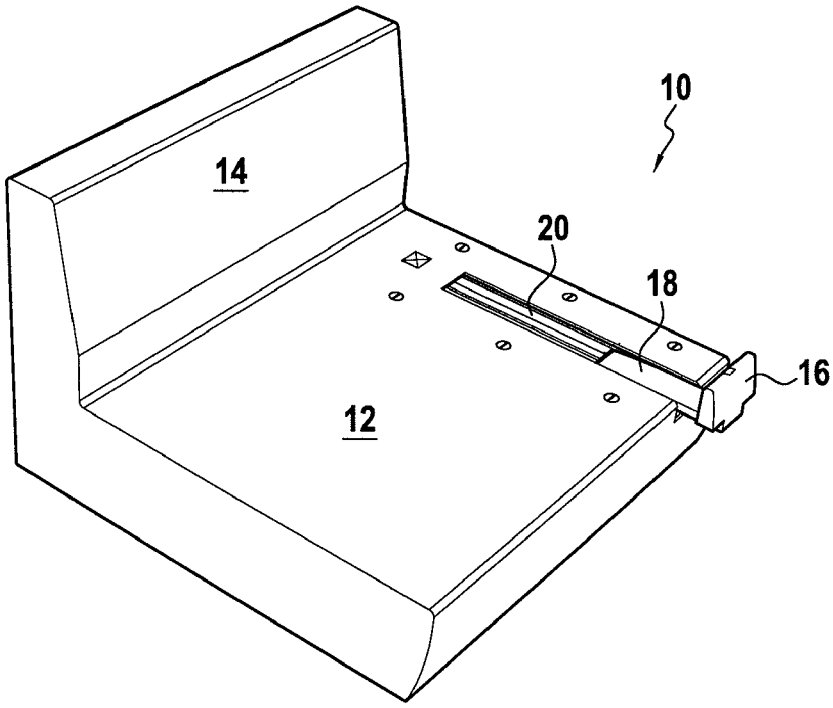
FIG. 1 is an external perspective view of a deck for receiving mailpieces, which deck is provided with a jogging device of the invention.

FIG. 1 is a perspective view of a mailpiece-receiving module of a document feeder of a mail handling machine. As is known, said module 10 is disposed upstream from a selection module having rollers for selecting and taking said mailpieces (see, for example, the above-mentioned French patent document). In conventional manner, said mailpiece-receiving module comprises a platform 12 on which the mailpieces are stacked, a referencing wall 14 that closes one side of the platform and that defines a direction of advance for the mailpieces, and a side jogging device for jogging the resulting stack of mailpieces against said referencing wall.

As shown, the side jogging device comprises a side jogging abutment 16 that is mounted to move in a direction perpendicular to the direction of advance of the mailpieces. Said side jogging abutment 16, which is mounted at the end of a bar 18, can be moved along a guide rail 20 mounted in the platform 12 between a first position (the closest to the referencing wall and shown in FIG. 2) corresponding to a minimum allowable format that can be accommodated by the mail handling machine, namely the "visiting card" format (140 millimeters (mm)×90 mm), and a second position (the furthest away from the referencing wall and shown in FIG. 1) corresponding to a maximum allowable format, namely the "landscape" C4 format (325 mm×230 mm).

Figure 2:
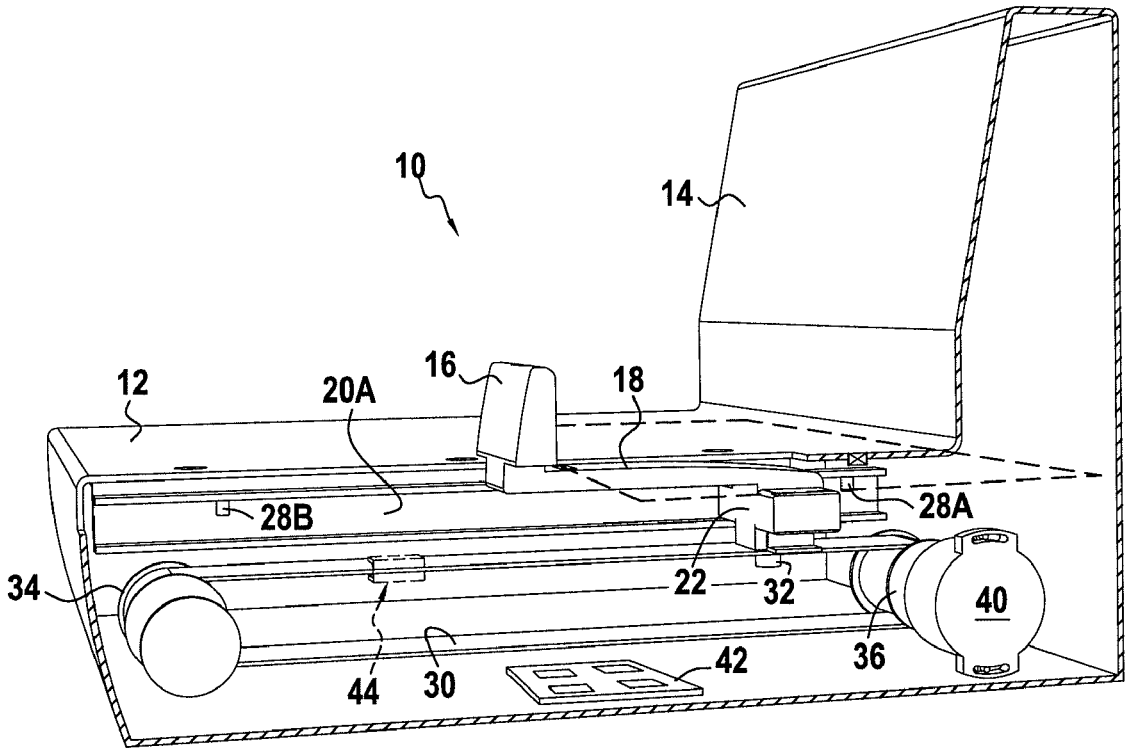
FIG. 2 is a cutaway perspective view of the FIG. 1 deck provided with the jogging device of the invention.
Figure 3:
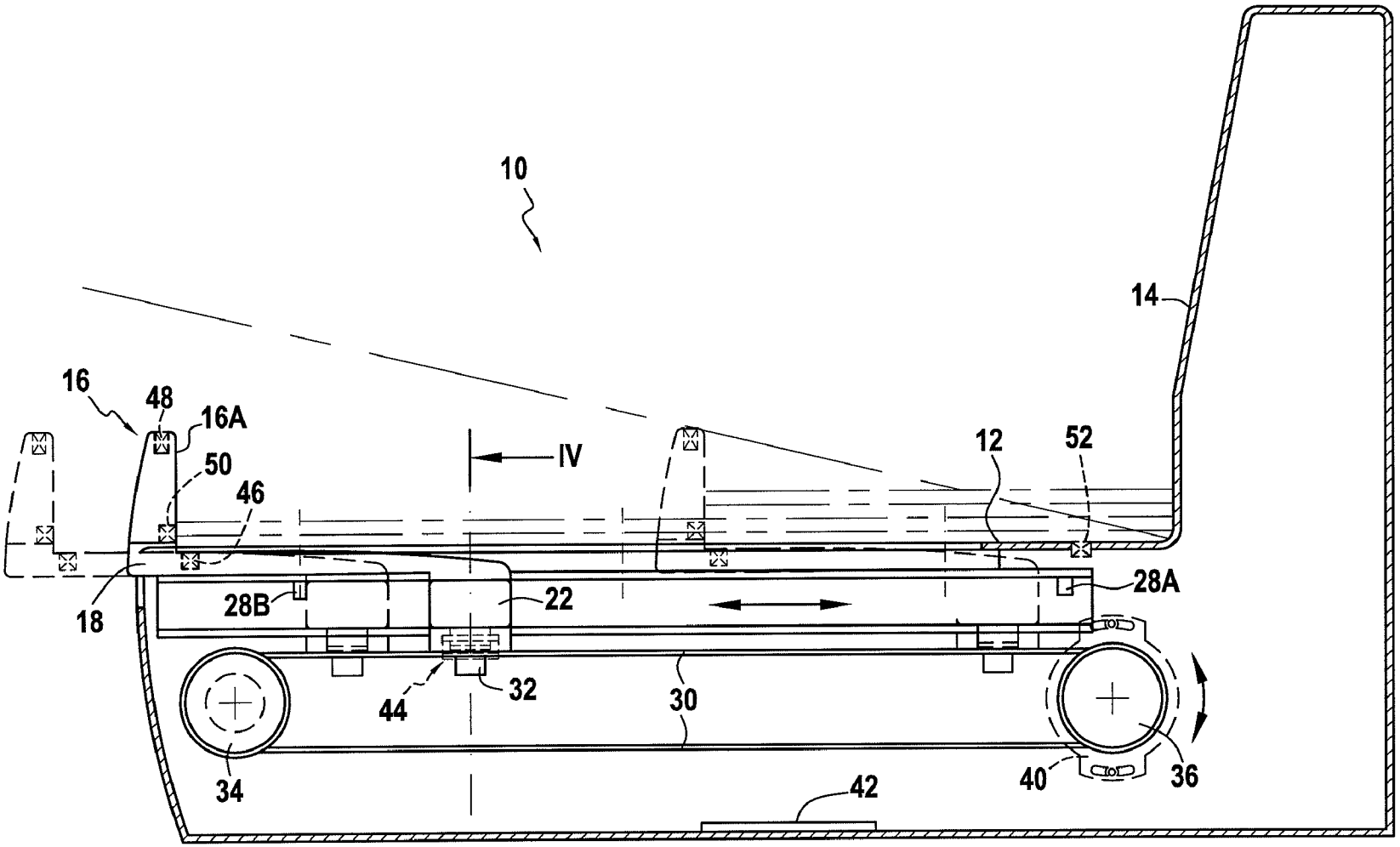
FIG. 3 is a section view at the jogging device of the FIG. 1 deck.
Figure 4:
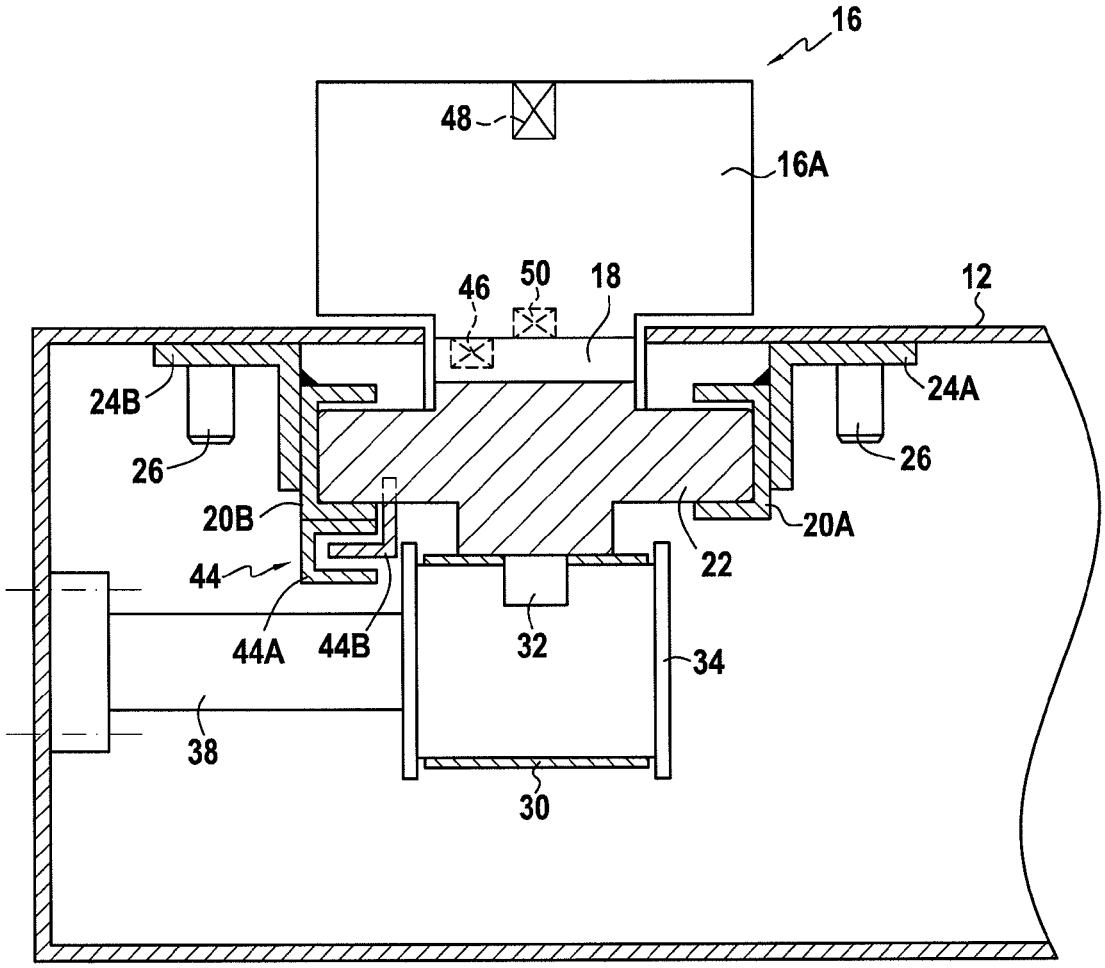
FIG. 4 is a section view on plane IV-IV of FIG. 3.

In accordance with the invention, and as shown more precisely in FIGS. 2 to 4, the side jogging device is motor-driven so that the positioning of the side jogging abutment 16 is adjusted automatically as a function of the width of the mailpiece disposed on the platform. More particularly, said side abutment is mounted at the end forming the head of the bar 18, and the other end of the bar, i.e. its end forming its foot, receives a T-shaped carriage 22 that is mounted to slide in two slide channels that are respectively [shaped (20A) and ] shaped (20B), that face each other, and that, together, form the guide rail 20. Said rail is held in position under the platform 12, e.g. by two angle brackets 24A, 24B fastened to the front face of said platform by advantageously-headless screws 26. The carriage can then move between two end-of-stroke abutments 28A, 28B under the action of a belt 30 that is secured to the carriage by a stud 32 passing through it and that is wound around two pulleys 34, 36 between which it moves and which are also disposed under the platform at respective ones of two opposite ends thereof, one of which pulleys (34) is mounted to rotate freely on a pin 38 that is secured to the structure of the mailpiece-receiving module, the other pulley (36) being driven by a drive motor 40 that is advantageously of the stepper type and that is controlled by a control circuit 42. The first end-of-stroke abutment 28A corresponds substantially to the side jogging abutment being positioned a little way inside the minimum allowable format, and the second end-of-stroke abutment 28B corresponds substantially to the side jogging abutment being positioned a little way outside the maximum allowable format.

Disposed between the two end-of-stroke abutments 28A, 28B on the path along which the carriage moves, a first sensor 44 having a stationary portion 44A fastened to one (20B) of the two slide channels and a moving portion 44B secured to the carriage 22 makes it possible to define a zero position for the drive motor 40. Preferably, this reference position corresponds to the jogging abutment being in a position in which it is aligned on the outside edge of the platform. This sensor is advantageously of the capacitive type.

The side jogging abutment is also provided with two position sensors, one of which (46) is fastened to the base of said jogging abutment where said abutment meets the bar 18, and the other which (48) is fastened to the top of said abutment. Said abutment can also be provided with a pressure sensor 50 that is disposed on an inside edge 16A of said abutment and that makes it possible to make the jogging control finer, e.g. by causing said side jogging abutment to move to an additional extent (in practice, back out again) by a few tenths of a millimeter after it has reached a maximum allowable pressure threshold. In addition, an envelope presence sensor 52 can also be mounted on the platform at the end of the guide rail. Naturally, each of said sensors, including the zero sensor, and the end-of-stroke abutments are connected to the control circuit 42 for which they constitute respective inputs, said control circuit having the drive motor as its single output (in order to make the drawings clearer, the links between these elements are not shown).

The jogging device of the invention operates as follows. In order to guarantee that the device operates properly, the operator must firstly place the envelopes from a batch to be franked in a pyramid configuration, i.e. with the widest envelopes at the bottom, and then the envelopes of medium width, and finally the envelopes of smallest width. Then the operator switches on the device, thereby causing the side jogging abutment to move towards its initial position at the edge of the platform, if it is not already in that position.

The operator can then place the batch of envelopes on the platform, thereby masking the presence sensor 52 and causing the side jogging abutment to move towards the referencing wall until it reaches the edges of the largest envelopes, said jogging abutment then in turn masking the first sensor 46 (for reasons of clarity, it is assumed that, in said first batch of envelopes, the largest envelopes are no wider than the width of the platform). When the pressure sensor 50 is present, it is said pressure sensor acting on the edges of the envelopes that accurately defines the instant at which the movement of the side jogging abutment is stopped.

The envelopes are then extracted one-by-one starting with the first envelope of the batch, i.e. the envelope placed at the very bottom of the stack, on the platform. Once the largest envelopes have all been extracted, the first sensor 46 is unmasked, thereby triggering movement of the side jogging abutment towards the referencing wall until it reaches the edges of the envelopes of medium size, thereby masking the first sensor again. The movement of the side jogging abutment is then stopped with the action on the pressure sensor 50 possibly being taken into account. As above, the envelopes of medium size are then extracted one-by-one to the last, thereby causing the first sensor to be unmasked and the side jogging abutment to be moved again. This movement ends when the abutment reaches the edges of the smallest envelopes and causes, for the last time, the first sensor 46 to be unmasked. Said small envelopes are then in turn extracted one-by-one to the last envelope in the batch, extraction of the last envelope, by unmasking the first sensor, causing the side jogging abutment to move for a last time against the end-of-stroke abutment 28A.

The module is then ready to handle a new batch of envelopes. For this purpose, the operator, who has previously prepared the batch in a pyramid configuration, places one or more of the largest-format envelopes of the batch on the platform, as shown in FIG. 3, i.e. with said envelope(s) resting in part on the end of the side jogging abutment 16. By masking the second sensor 48, said envelope(s) being placed in this way causes the side jogging abutment to move backwards (away from the referencing wall) until said envelope(s) fall(s) flat onto the platform, said second sensor being unmasked causing the movement to stop, optionally under the control of the pressure sensor 50. The operator can then, as of this instant, place the rest of the stack on said envelope(s), said rest of the stack then being handled as above.

Thus, with the invention, it is possible to obtain almost automatic handling of the mailpieces, action from the operator being reduced to merely feeding the mailpiece-receiving module with successive stacks of mailpieces organized in pyramid configurations.

It should be noted that, although the invention as described above requires at least the use of four sensors, two sensors at the side jogging abutment, a zero sensor at the guide rail, and an envelope presence sensor on the platform, it is however possible to obtain the same features with only the two sensors on the side jogging abutment, subject to the side jogging abutment operating slightly differently. Thus, the rest position of the side jogging abutment should not be set at the edge of the platform but rather it should be as close as possible to the referencing wall, and more precisely in contact with the end-of-stroke abutment 28A which, it should be recalled, is disposed inside the minimum format of the envelopes to be handled.

In this rest position, the two sensors 46 and 48 are unmasked but, since the drive motor 40 is in abutment, there can be no movement of the side jogging abutment 16 towards the referencing wall.

Conversely, by masking the second sensor 48, a first stack of envelopes being placed on the platform causes the side jogging abutment to move backwards rather than forwards (i.e. to move away from the referencing wall) until said stack (or the first envelopes in the stack) fall flat onto the platform, the second sensor being unmasked then causing the movement to stop automatically. The stack is then handled as above, with the successive advances of the side jogging abutment, said side jogging abutment ending its stroke in its rest position against the end-of-stroke abutment 28A once all of the envelopes in the stack have been extracted.

Naturally, as in the initial embodiment, adding a pressure sensor 50 can make it possible to jog the stack of envelopes with more precision by means of the side jogging abutment moving to an additional extent. It should be noted that said pressure sensor can, alternatively, be disposed at the referencing wall in register with said side jogging abutment.

What is claimed is:

1. A jogging device for a feeder of a mail handling machine, which jogging device comprises:

a side jogging abutment mounted to move, under the action of a drive motor, along a guide rail that is disposed perpendicularly to a referencing wall;

a controller, wherein said side jogging abutment is provided with at least:

a first sensor means fastened to a base of the side jogging abutment for, when unmasked, causing, via said controller, said jogging abutment to move towards said referencing wall, and, when masked, causing said movement to stop; and a second sensor means fastened to a top of said side jogging abutment for, when masked, causing, via said controller, said jogging abutment to move away from said referencing wall, and, when unmasked, causing said movement to stop.

2. A jogging device according to claim 1, wherein said side jogging abutment is further provided with a pressure sensor means disposed on an inside edge of said side jogging abutment for causing said side jogging abutment to move to an additional extent as a function of the pressure exerted by said inside edge on said mailpieces.

3. A jogging device according to claim 1, wherein said platform is further provided with an envelope presence sensor means disposed in a vicinity of said referencing wall and passing through said platform, for detecting the presence of at least one mailpiece on said platform.

4. A jogging device according to claim 1, wherein said side jogging abutment is mounted at an end of a bar that forms a head end of the bar, and an opposite end of the bar receives a T-shaped carriage that is mounted to slide in two slide channels that face each other, and that, together, form said guide rail.

5. A jogging device according to claim 4, wherein said carriage is mounted to move between two end-of-stroke abutments, and is secured to a belt moving between two pulleys, one of which is mounted to rotate freely on a pin secured to the structure of the mailpiece-receiving module, and the other of which is driven by said drive motor.

6. A jogging device according to claim 5, wherein said first end-of-stroke abutment is disposed such that said side jogging abutment is positioned slightly inside the minimum allowable format, and said second end-of-stroke abutment is disposed such that said side jogging abutment is positioned slightly outside the maximum allowable format.

7. A jogging device according to claim 4, further comprising a position sensor means for defining a reference zero position for said drive motor, a stationary portion of said position sensor means being fastened to said guide rail and a moving portion of said position sensor means being secured to said carriage.

8. A jogging device according to claim 7, wherein said reference zero position corresponds to a position at which said side jogging abutment is aligned on the outside edge of said platform.

9. A feeder for a mail-handling machine, which feeder includes a jogging device according to claim 1.

* * * * *